US005634787A

United States Patent [19]

Frigiere

[11] Patent Number: 5,634,787

[45] Date of Patent: Jun. 3, 1997

[54] CIGARETTE LIGHTER INCLUDING A SAFETY IGNITION SYSTEM

[75] Inventor: René Frigiere, Charbonnieres, France

[73] Assignee: Cricket, Rillieux La Pape, France

[21] Appl. No.: 657,099

[22] Filed: Jun. 3, 1996

[30] Foreign Application Priority Data

Jul. 6, 1995 [FR] France ..... 95 08478

[51] Int. Cl.[6] ..... F23D 11/36

[52] U.S. Cl. ..... 431/153; 431/277

[58] Field of Search ..... 431/153, 277

[56] References Cited

U.S. PATENT DOCUMENTS

| | | | |
|---|---|---|---|
| 5,002,482 | 3/1991 | Fairbanks et al. . | |
| 5,125,829 | 6/1992 | McDonough et al. . | |
| 5,197,870 | 3/1993 | Yang . | |
| 5,271,731 | 12/1993 | Hsin-Chung . | |
| 5,490,773 | 2/1996 | Loveras Capilla | 431/153 |

FOREIGN PATENT DOCUMENTS

| | | |
|---|---|---|
| 93/17282 | 9/1993 | France . |
| 95/04247 | 2/1995 | WIPO . |

*Primary Examiner*—Carl D. Price
*Attorney, Agent, or Firm*—Oliff & Berridge

[57] ABSTRACT

A cigarette lighter for use with a volume of fuel includes a body. At least one projection extends from the body and defines at least one opening, which includes a first area bounded on at least one side by a curved leg and a second area bounded on at least one side by a flat leg. An ignition system includes a flint, a knurled wheel, and at least one elongated stub coaxial with the knurled wheel. A cross-section of the at least one stub has at least one flattened face. An engagement portion of the at least one stub extends into the at least one opening such that the knurled wheel is moveable between a first resting position wherein the engagement portion of the at least one stub is disposed in the second area of the at least one opening such that the at least one flattened face of the at least one stub communicates with the flat leg of the at least one opening to prevent the knurled wheel from rotating relative to the flint, and a second operational position wherein the engagement portion of the at least one stub is disposed within the first area of the at least one opening such that the knurled wheel is rotatable relative to the flint.

15 Claims, 3 Drawing Sheets

CIGARETTE LIGHTER INCLUDING A SAFETY IGNITION SYSTEM

BACKGROUND OF THE INVENTION

The present invention relates to a cigarette lighter including a safety ignition system.

A cigarette lighter generally includes a tank designed to contain a fuel such as liquefied petroleum gas, a valve mounted on the tank allowing the gas to leave the tank, a lever-controlled system for opening and closing the gas flow, a gas flowrate regulating system, and an ignition system. In known fashion, the latter comprises a flint cooperating with a knurled wheel and, usually, a protective cap. The knurled wheel is mounted on a shaft between two drive wheels.

When the knurled wheel, in contact with the flint, is made to rotate by means of drive wheels and the user's finger, a shower of sparks is created and is followed, when this same finger acts on the gas opening lever, by release of a quantity of gas. The shower of sparks then ignites the gas, producing a flame which projects above the cap.

Such a system already requires positive action on the part of the user to produce and maintain a flame and requires two movements that are independent of each other—rotation of the knurled wheel and action on the gas opening lever—to produce a flame.

However, it is a goal to increase the difficulty of using such lighters, so that children under the age of five cannot produce flames therewith.

There already exist lighters in which an additional difficulty must be overcome to produce a flame, and several patents or patent applications describe such lighters, such as U.S. Pat. No. 5,125,829 and 5,002,482 or international patent applications WO-93/17282 and WO-95/04247.

The cigarette lighters described in these documents, have, by comparison to a lighter of the prior art, an additional device rendering access to the drive wheels of the knurled wheel more difficult or blocking movement of the gas opening lever.

Because of this, these lighters have a complex structure entailing high manufacturing costs. Moreover, use of these lighters is complicated and requires a set of instructions. Even adults may experience some difficulty in using such lighters and require a learning period.

SUMMARY OF THE INVENTION

A goal of the present invention is to furnish a cigarette lighter easily usable by an adult but difficult for a child, particular a child under five years of age, to use, which has few differences from a cigarette lighter of the aforementioned type.

Another goal of the invention is to furnish a reliable, tamperproof safety system that is constantly in action, without prior intervention.

Another goal is for the operation of the lighter to be as close as possible to operation of a lighter of the aforementioned type, so that the user needs no instructions and no prior learning before using the lighter.

For this purpose, the invention relates to a gas cigarette lighter of the type having a tank designed to contain a liquefied petroleum gas, a valve mounted on the tank and allowing the gas to leave the latter, a gas flow opening and closing system, as well as an ignition system having a flint cooperating with a knurled wheel and a spring keeping the flint in contact with the knurled wheel, the latter being driven rotationally by at least one drive wheel mounted coaxially with the knurled wheel.

According to the invention, the assembly formed by the knurled wheel and the drive wheel is equipped, for purposes of rotating it relative to the lighter body, with two coaxial stubs each of which has at least one flat side and is accommodated in an opening provided in the body or in a part mounted thereon and having two legs, a first leg whose end is rounded with a sufficiently large radius of curvature to allow the stub to rotate when it is accommodated in this leg, and a second leg having a flat surface designed to cooperate with the flat side of the stub to immobilize the latter rotationally when the stub is accommodated in this leg.

To operate this lighter, the user brings the assembly formed by the knurled wheel and the drive wheels into a position such that the stubs are engaged in the leg that has a rounded end, then turns the knurled wheel as he would do with a standard lighter. This pre-positioning is done with the same finger used to turn the knurled wheel and is thus not a prior action.

The modifications made by comparison to a standard lighter are not substantial. Indeed, the main and preferably only change is that the invention modifies the stubs and the openings designed to receive them. Thus, it is easy to mass-produce the lighters according to the invention.

DETAILED DESCRIPTION OF PREFERRED EMBODIMENTS

In a preferred embodiment, each opening in which a stub is engaged has the general shape of a V whose vertex is oriented on the side opposite the flint such that the spring that applies the flint against the knurled wheel pushes the corresponding stub to the vertex of the V when said spring is in the resting position. As soon as the user is no longer applying pressure to the drive wheels, the stubs, under the elastic effect of the spring, resume the resting position in the vertex of the V. When the user picks the lighter up again and wishes to use it, he then acts on the drive wheels in the direction pushing the stubs toward the legs that are rounded at their ends.

Advantageously, the leg of the V of the opening, which has a flat surface, is located near the end of the lever on which the user acts to cause gas to leave the tank. Indeed, the natural tendency of the user, and hence to an even greater degree that of a child, is to exert an action on the drive wheels that tends to bring them closer to this end of the lever.

In one advantageous embodiment, each stub is triangular in cross section or, more generally, the cross sections of the stubs are polygonal.

In one embodiment of the invention, each of the openings accommodating the stubs is made in one mounting tab that forms a single unit with the body of the lighter. These mounting tabs can also serve to articulate the lever to control the opening and closing of the gas flow, and serve to attach a protective cap.

In any event, the invention will be thoroughly understood with the aid of the description which follows with reference to the attached schematic diagrams representing, as a non-limiting example, one embodiment of this gas lighter.

Figure 1:
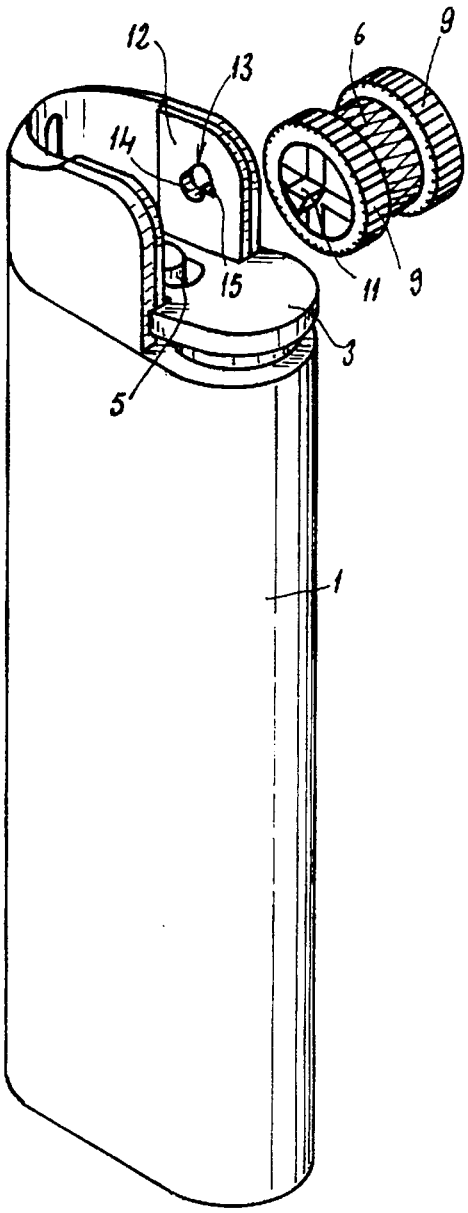
FIG. 1 is a perspective view of a lighter according to the invention.
Figure 2:
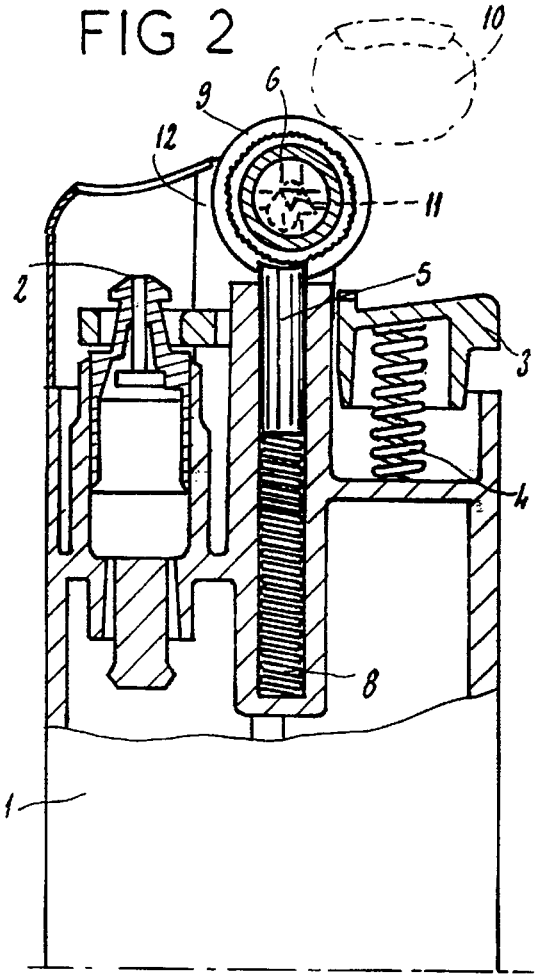
FIG. 2 is a side view, partially in section and on an enlarged scale, of the lighter of FIG. 1.
Figure 3:
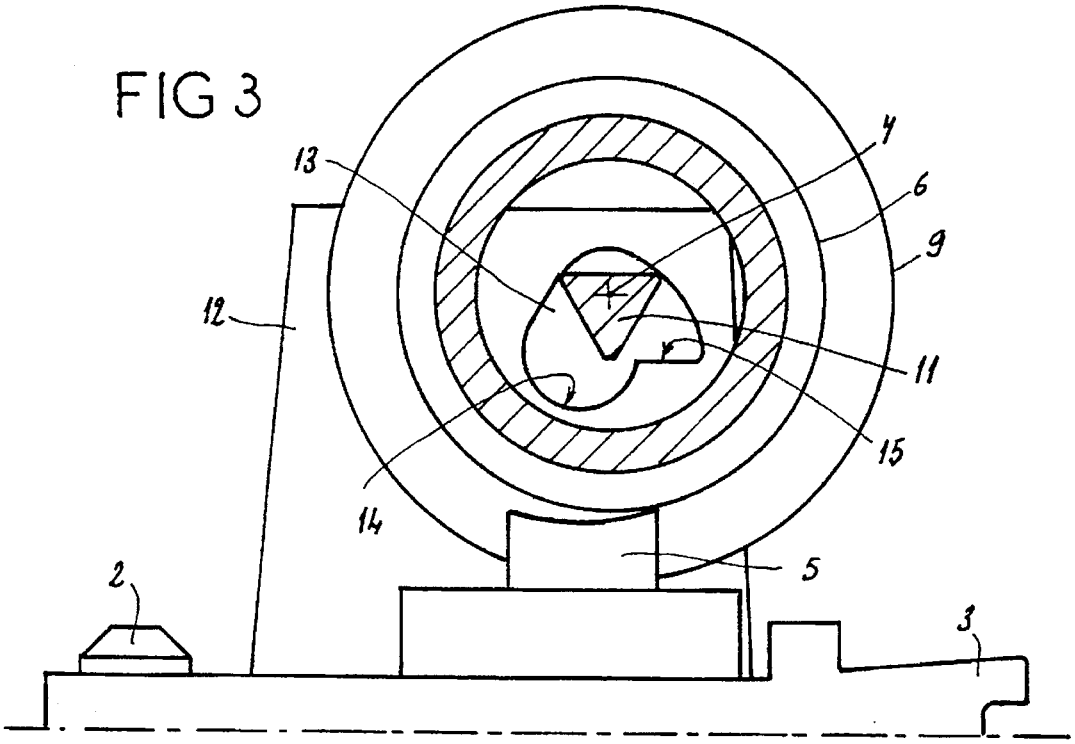
FIG. 3 is a view in cross section on an enlarged scale of the ignition system in the resting position, FIG. 4 corresponds to the view of FIG. 3 but in the locked position, and FIG. 5 corresponds to the view of FIG. 3 but in the operating position.
Figure 4:
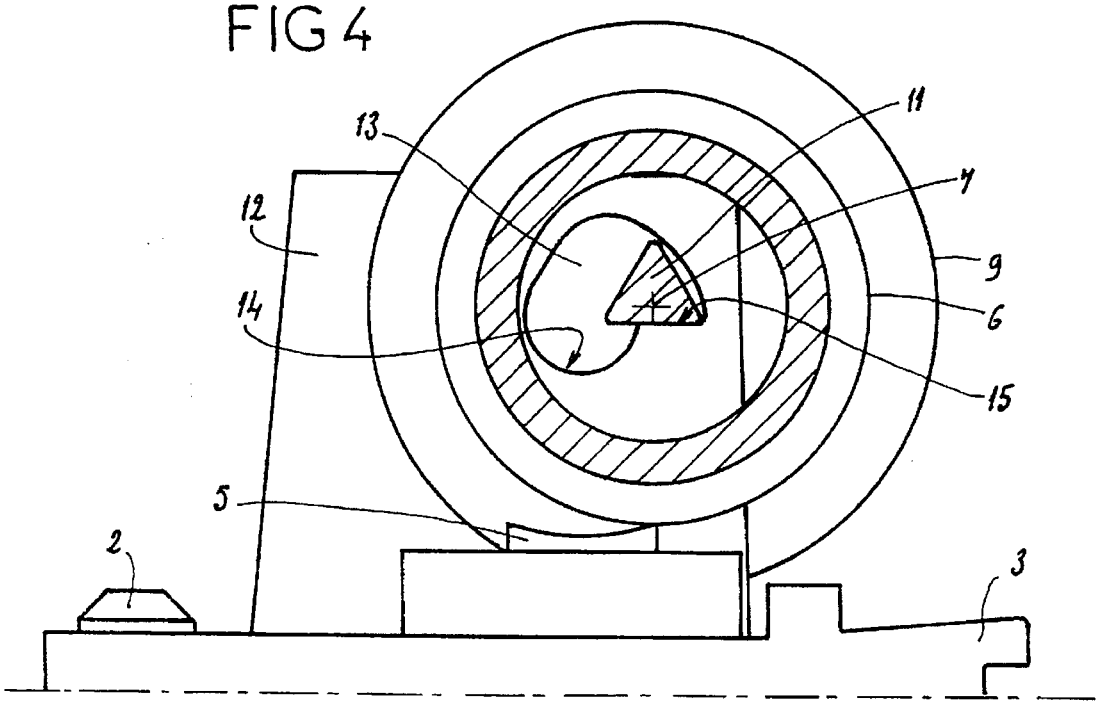
Figure 5:
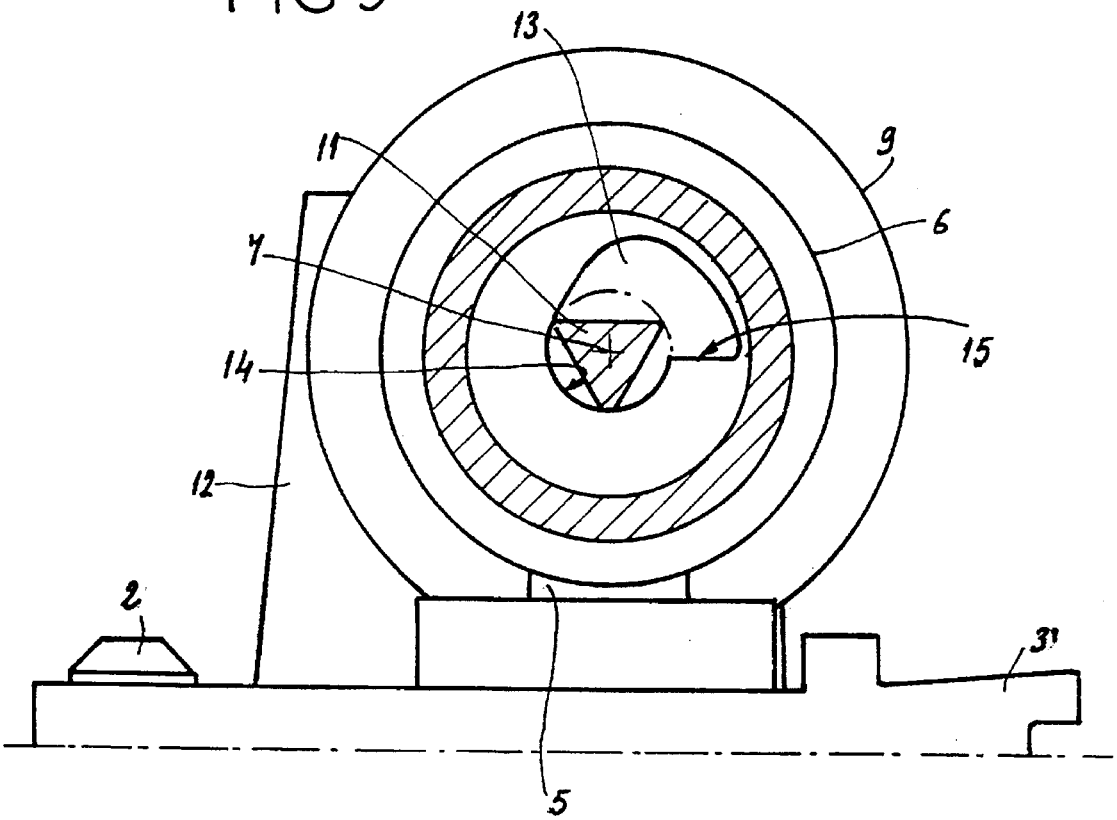

FIGS. 1 and 2 show a gas cigarette lighter having, in known fashion, a body 1 acting as a tank and designed to contain liquefied petroleum gas.

In the upper part, the tank is provided with a valve 2 allowing gas to escape when valve 2 is in the open position. A lever 3 controls the opening and closing of valve 2. A spring 4 acts on lever 3 such that, in the resting position, valve 2 is closed. The part of lever 3 located opposite valve 2 is activated by the user when the latter wishes gas to escape from the tank, to feed a flame for example.

The lighter also has an ignition system allowing the gas leaving valve 2 to be ignited. This system has a flint 5 and a knurled wheel 6. The latter is mounted on a shaft 7 and can rotate about the latter. It is cylindrical in shape and its peripheral surface is knurled.

Flint 6 abuts knurled wheel 6 radially. A spring 8 keeps it in contact. Thus, when knurled wheel 6 rotates on its shaft 7, sparks are produced and can ignite gas escaping from valve 2.

Coaxially with knurled wheel 6, two drive wheels 9 are mounted one on each side of said knurled wheel. These drive wheels 9 can form a single unit with knurled wheel 6, or they can be separate parts rendered integral with knurled wheel 6.

These drive wheels 9 are circular disks whose peripheral surfaces forming the edges are notched. Thus, the coefficient of friction between a finger 10 of the user and these drive wheels 9 is high.

The assembly formed by knurled wheel 6 and drive wheels 9 is provided, at shaft 7, on each side, with a cylindrical stub 11 that has a triangular cross section.

Near knurled wheel 6 and lever 3, the tank body has two tabs 12 serving to hold in particular lever 3, as well as a protective cap and the assembly constituted by knurled wheel 6 and the drive wheels. All these elements are located between these two mounting tabs 12 which form a single molded part with body 1 of the lighter.

Each of stubs 11 is accommodated in an opening 13 provided in a mounting tab 12. Each opening 13 has the general shape of a V, thus defining three positions for corresponding stub 11: two positions when this stub is at the end of one leg of the V and the third position when it is in the vertex of the V. The latter is opposite the recess receiving flint 5 and spring 8.

The first leg of the V, the one located near valve 2, is rounded at its end 14. The radius of curvature is sufficiently large to allow corresponding stub 11 to rotate when the latter is located in this leg. It is sufficient for this radius of curvature to be greater than the radius of the circle circumscribing the triangular section of stub 11.

The second leg of the V, opposite valve 2 and near lever 3 designed to be contacted by a finger 10 of the user, terminates in a flat surface 15. Thus, when stub 11 engages this end of opening 13, a flat face of stub 11 abuts flat surface 15, thus preventing any rotation of the assembly formed by knurled wheel 5 and drive wheels 9.

Finally, the base of the V is such that it can accommodate corresponding stub 11 in any position. At rest, when no action is exerted on drive wheels 9, stub 11 is accommodated in the base of the V because flint 5, under the action of spring 8 and through the intermediary of knurled wheel 6, pushes stubs 11 into this position, the base of the V being opposite the recess of spring 8.

When using the lighter, the user exerts a pressure on drive wheels 9 that counters spring 8 and stubs 11 accordingly move to one or another of the legs of opening 13.

The tendency of the user, particularly a child, is to exert an action on drive wheels 9 that tends to bring them closer to the part of the lever that must be pressed to cause gas to escape, namely to cause stubs 11 to penetrate the legs of opening 13 that are provided with a flat surface 15. When this action is carried out, rotation of knurled wheel 6 is blocked, preventing any sparks from being struck.

To use the lighter, one must thus first push the assembly formed by knurled wheel 6 and drive wheels 9 to valve 2, then turn this assembly to produce sparks and ignite the gas leaving the valve after acting on lever 3.

The modifications to a lighter according to the invention relative to a lighter of the prior art are not substantial. Indeed, the shape of opening 13 and the shape of the receiving stubs 11 are the main and preferably only modifications.

The operation of this lighter is very similar to that of a standard lighter. Once the knurled wheel plus drive assembly is pre-positioned, operation is identical to that of a standard lighter.

This safety system is continuously in action. The user grasps this lighter according to the invention in the same way as a standard lighter and no prior action is necessary since it is only the user's finger, generally a thumb, that acts on drive wheels 9.

This safety system is also tamperproof because it is not a device added to a standard lighter which can be removed, but results from a new lighter design.

It goes without saying that the invention is not confined to the embodiment of the invention described above as a nonlimiting example, but encompasses all the variants thereof.

Thus, for example, the stubs can be polygonal rather than triangular in cross section, or simply have a circular cylindrical cross section with a flat side without thereby departing from the framework of the invention.

Likewise, the openings receiving the stubs could be made in the mounting tabs independently of the lighter body, and mounted on the latter by latching for example.

What is claimed is:

1. A cigarette lighter for use with a volume of fuel, comprising:

a body;

at least one projection extending from the body and defining at least one opening that includes a first area bounded on at least one side by a curved leg and a second area bounded on at least one side by a flat leg; and an ignition system including a flint, a knurled wheel, and at least one elongated stub coaxial with the knurled wheel, a cross-section of the at least one stub having at least one flattened face, an engagement portion of the at least one stub extending into the at least one opening such that the knurled wheel is moveable between a first resting position wherein the engagement portion of the at least one stub is disposed in the second area of the at least one opening such that the at least one flattened face of the at least one stub communicates with the flat leg of the at least one opening to prevent the knurled wheel from rotating relative to the flint, and a second operational position wherein the engagement portion of the at least one stub is disposed within the first area of the at least one opening such that the knurled wheel is rotatable relative to the flint.

2. A cigarette lighter according to claim 1, further comprising a tank disposed in an aperture of the body for accommodating the fuel.

3. A cigarette lighter according to claim 2, wherein the fuel is liquified petroleum gas.

4. A cigarette lighter according to claim 3, further comprising a valve mounted on the tank and a controller for actuating the valve to controllably release fuel from the tank.

5. A cigarette lighter according to claim 4, further comprising a spring disposed to hold the flint against the knurled wheel.

6. A cigarette lighter according to claim 5, further comprising a drive wheel mounted to, and coaxial with, the knurled wheel, the knurled wheel and drive wheel forming a drive assembly, whereby the drive wheel is operated manually to rotate the knurled wheel.

7. A cigarette lighter according to claim 6, wherein the at least one stub includes a pair of stubs, the stubs being attached to opposite sides of the drive assembly.

8. A cigarette lighter according to claim 7, wherein the at least one opening is substantially V-shaped such that a vertex of the at least one substantially V-shaped opening is disposed opposite the flint, and the spring pushes the at least one stub to the vertex of the at least one substantially V-shaped opening when the knurled wheel is in the first resting position.

9. A cigarette lighter according to claim 8, wherein the controller includes a manually operable lever and the flat leg of the at least one opening is adjacent the lever.

10. A cigarette lighter according to claim 1, wherein the at least one projection and the body are formed as a single integral unit.

11. A cigarette lighter according to claim 1, wherein the at least one projection is attached to the body.

12. A cigarette lighter according to claim 1, wherein a radius of curvature of the curved leg of the first area of the at least one opening is large enough to allow the at least one stub to rotate when the engagement portion of the stub is disposed in the first area of the at least one opening.

13. A cigarette lighter according to claim 1, wherein the at least one stub has a polygonal cross-section.

14. A cigarette lighter according to claim 1, wherein the at least one stub has a triangular cross-section.

15. A cigarette lighter according to claim 1, wherein the at least one projection is a mounting tab that is integral with the body.

* * * * *